US011728068B2

(12) United States Patent
Leach et al.

(10) Patent No.: US 11,728,068 B2
(45) **Date of Patent: *Aug. 15, 2023**

(54) MAGNET WIRE WITH CORONA RESISTANT POLYIMIDE INSULATION

(71) Applicant: Essex Furukawa Magnet Wire USA LLC, Atlanta, GA (US)

(72) Inventors: Matthew Leach, Fort Wayne, IN (US); James J. Connell, Fort Wayne, IN (US); Allen Roe Guisinger, Huntertown, IN (US); Allan R. Knerr, Fort Wayne, IN (US); Frederick Marshall McFarland, Fort Wayne, IN (US); Tamanna Ferdous McFarland, Fort Wayne, IN (US); Mohammad Mazhar Said, South Barrington, IL (US)

(73) Assignee: Essex Furukawa Magnet Wire USA LLC, Atlanta, GA (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/731,350

(22) Filed: Apr. 28, 2022

(65) Prior Publication Data

US 2022/0254542 A1 Aug. 11, 2022

Related U.S. Application Data

(63) Continuation-in-part of application No. 17/316,333, filed on May 10, 2021, now Pat. No. 11,352,521, (Continued)

(51) Int. Cl.
*H01B 3/02* (2006.01)
*H01B 3/30* (2006.01)

(52) U.S. Cl.
CPC ..... *H01B 3/306* (2013.01); *H01B 3/305* (2013.01)

(58) Field of Classification Search
CPC . H01B 3/305; H01B 7/02; H01B 7/04; H01B 7/06; H01B 7/2813; H01B 3/306;
(Continued)

(56) References Cited

U.S. PATENT DOCUMENTS 2,809,229 A * 10/1957 Eckels ..... H01B 7/38 174/117 R
3,554,984 A * 1/1971 Edwards et al. ..... C08G 73/14 528/331

(Continued)

OTHER PUBLICATIONS

Office Action dated Dec. 8, 2022 for U.S. Appl. No. 17/731,357.
Office Action dated Oct. 4, 2022 for U.S. Appl. No. 17/398,973.

*Primary Examiner* — William H. Mayo, III

(57) ABSTRACT

Magnet wire with corona resistant enamel insulation may include a conductor and a multi-layer insulation system formed around the conductor. The insulation system may include a basecoat formed from a first polymeric enamel insulation. A midcoat formed from a second polymeric enamel insulation may be formed around the basecoat, and the second polymeric enamel insulation may include a filler dispersed in a base polyimide material. The filler may include between 20 percent and 80 percent by weight of silica dioxide and between 20 and 80 percent by weight of titanium dioxide. Additionally, the insulation system may include a topcoat formed from third polymeric enamel insulation formed around the midcoat.

21 Claims, 2 Drawing Sheets

Related U.S. Application Data which is a continuation-in-part of application No. 17/003,503, filed on Aug. 26, 2020, now Pat. No. 11,004,575, which is a continuation-in-part of application No. 16/403,665, filed on May 6, 2019, now Pat. No. 10,796,820.

(60) Provisional application No. 62/667,649, filed on May 7, 2018.

(58) Field of Classification Search
CPC ..... H01B 3/30; H01B 3/427; H01B 3/002; H01B 3/32; H01B 19/04; H02K 3/32; H02K 3/04; C09D 179/08; C09D 167/00
USPC ..... 174/110 R–113 R, 120 R–122 SR
See application file for complete search history.

(56) References Cited

U.S. PATENT DOCUMENTS 4,005,056 A * 1/1977 Dunwald ..... C08G 18/3825 528/53
4,273,829 A * 6/1981 Perreault ..... H01B 7/0275 174/110 V
4,381,362 A * 4/1983 Biggs ..... C08K 5/372 524/264
4,430,384 A 2/1984 George
4,447,797 A * 5/1984 Saunders ..... H01B 3/40 174/120 SR
4,537,804 A 8/1985 Keane
4,597,804 A * 7/1986 Imaoka ..... H01L 21/324 257/E21.321
4,760,296 A * 7/1988 Johnston ..... H01B 3/006 310/196
4,935,302 A 6/1990 Hjortsberg
5,654,095 A * 8/1997 Yin ..... H02K 3/34 174/120 SR
6,337,442 B1 * 1/2002 Lienert ..... H01B 3/308 174/120 R
6,352,230 B2 * 3/2002 Grossman ..... E02D 29/0283 248/351
6,437,249 B1 * 8/2002 Higashiura ..... H01B 3/427 174/120 R
7,253,357 B2 * 8/2007 Cipelli ..... H02K 3/30 174/110 R
2005/0118422 A1 * 6/2005 Cipelli ..... H01B 3/306 428/375
2008/0289850 A1 * 11/2008 Mhetar ..... H01B 3/441 524/505
2012/0285724 A1 * 11/2012 Oya ..... H01B 3/427 174/120 C
2015/0243410 A1 * 8/2015 Knerr ..... H01B 3/307 310/198
2016/0233003 A1 * 8/2016 Caudill ..... H01B 3/081
2020/0402684 A1 * 12/2020 Tanaka ..... H01B 13/228

* cited by examiner

MAGNET WIRE WITH CORONA RESISTANT POLYIMIDE INSULATION

CROSS-REFERENCE TO RELATED APPLICATION

This application is a continuation-in-part of U.S. patent application Ser. No. 17/316,333, filed May 10, 2021 and entitled "Magnet Wire with Corona Resistant Polyamideimide Insulation", which is a continuation-in-part of U.S. Pat. No. 11,004,575, filed Aug. 26, 2020 and entitled "Magnet Wire with Corona Resistant Polyimide Insulation", which is a continuation-in-part of U.S. Pat. No. 10,796,820, filed May 6, 2019 and entitled "Magnet Wire with Corona Resistant Polyimide Insulation", which claims priority to U.S. Provisional Application No. 62/667,649, filed May 7, 2018 and entitled "Corona Resistant Polyimide Magnet Wire Insulation". The contents of each of these prior matters is incorporated by reference herein in its entirety.

TECHNICAL FIELD

Embodiments of the disclosure relate generally to magnet wire and, more particularly, to magnet wire that includes insulation systems incorporating corona resistant polyimide designed to improve the life and thermal conductivity of motor windings.

BACKGROUND

Magnet wire, also referred to as winding wire or magnetic winding wire, is utilized in a wide variety of electric machines and devices, such as inverter drive motors, motor starter generators, transformers, etc. Magnet wire typically includes polymeric enamel insulation formed around a central conductor. The enamel insulation is formed by applying a varnish onto the wire and curing the varnish in an oven to remove solvents, thereby forming a thin enamel layer. This process is repeated until a desired enamel build or thickness is attained. Polymeric materials utilized to form enamel layers are intended for use under certain maximum operating temperatures. Additionally, electrical devices may be subject to relatively high voltage conditions that may break down or degrade the wire insulation. For example, an inverter may generate variable frequencies that are input into certain types of motors, and the variable frequencies may exhibit steep wave shapes that cause premature motor winding failures.

Attempts have been made to reduce premature failures as a result of degradation of the wire insulation. These attempts have included minimizing damage to the wire and insulation during handling and manufacture of electric machines and devices, and using shorter lead lengths where appropriate. Further, a reactor coil or a filter between an inverter drive and a motor can extend the life of the windings by reducing the voltage spikes and high frequencies generated by the inverter drive/motor combination. However, such coils are expensive and add to the overall cost of the system. Increasing the amount of insulation can improve the life of the windings in an electrical device, but this option is both expensive and decreases the amount of space for the copper in the device, thereby producing a less efficient motor. Additionally, inter layer delamination may occur once a certain number of enamel layers has been reached. Therefore, there is an opportunity for improved magnet wire with insulation designed to withstand higher temperatures and/or voltages present within electrical devices for longer periods of time.

BRIEF DESCRIPTION OF THE DRAWINGS

The detailed description is set forth with reference to the accompanying figures. In the figures, the left-most digit(s) of a reference number identifies the figure in which the reference number first appears. The use of the same reference numbers in different figures indicates similar or identical items; however, various embodiments may utilize elements and/or components other than those illustrated in the figures. Additionally, the drawings are provided to illustrate example embodiments described herein and are not intended to limit the scope of the disclosure.

DETAILED DESCRIPTION

Figure 1A:
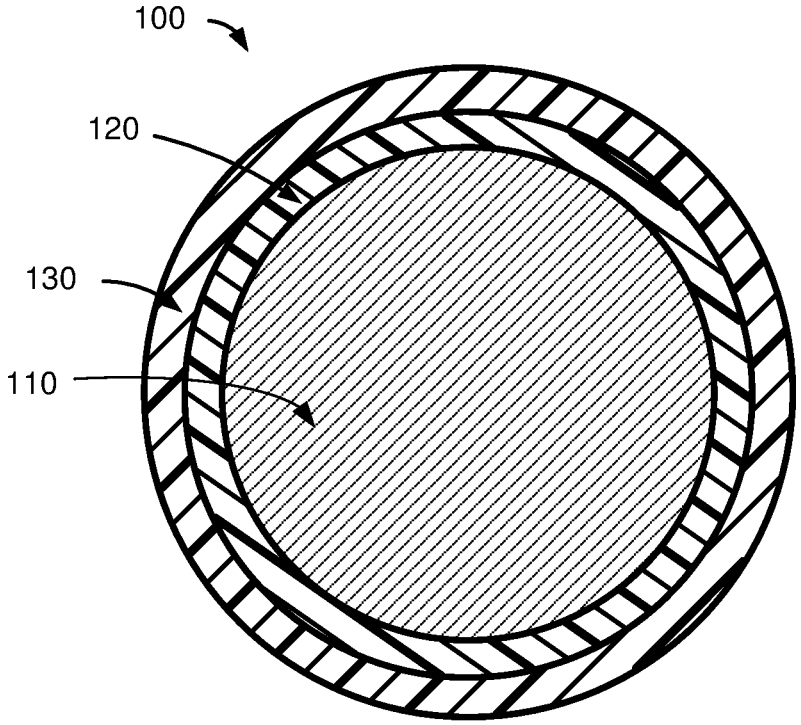
FIGS. 1A-2B illustrate cross-sectional views of example magnet wire constructions that may be formed in accordance with various embodiments of the disclosure.

Certain embodiments of the present disclosure are directed to magnet wire that includes at least one layer of polyimide ("PI") enamel insulation having improved corona resistance, thermal conductivity, and/or thermal life enhancement relative to conventional PI insulation. An improved PI insulation layer may include filler material added to a PI polymer or resin. The filler material may include a blend of at least titanium(IV) oxide ($TiO_2$) (also referred to as titanium dioxide) and silica dioxide ($SiO_2$) (also referred to as silica). A blend may additionally include other suitable materials as desired, such as chromium(III) oxide ($Cr_2O_3$) (also referred to as chromium oxide). The addition of the filler may improve the corona resistance and/or thermal life of an enamel layer formed from filled PI and/or a magnet wire insulation system that incorporates a filled PI enamel layer. As a result, the life of the magnet wire and/or an electrical device (e.g., motor, etc.) incorporating the magnet wire may be increased or extended under partial discharge and/or other adverse conditions. In certain embodiments, the addition of the filler may also improve the thermal conductivity of the magnet wire.

Filler material may be added to PI at any suitable ratio to form a filled PI layer. For example, a total amount of filler may be between approximately ten percent (10%) and approximately twenty-five percent (25%) by weight, such as approximately fifteen percent (15%) by weight. A wide variety of blending or mixing ratios may be utilized for various components incorporated into a filler. For example, titanium dioxide and silica dioxide may be blended at a wide variety of suitable ratios by weight. In various embodiments, a filler may include between approximately twenty percent (20%) and approximately eighty percent (80%) by weight of silica dioxide and between approximately twenty percent (20%) and approximately eighty (80%) by weight of titanium dioxide.

In certain embodiments, one or more filled PI layers may be combined with additional enamel insulation layers in an overall magnet wire insulation system. For example, one or more filled PI layers may be combined with one or more additional layers of enamel formed from polyester, THEIC polyester, polyester imide, polyamideimide ("PAI"), unfilled PI, and/or other suitable materials. Each additional layer of enamel may be formed as an unfilled layer or as a filled layer that includes any suitable filler materials. Further, any suitable number of additional layers may be combined with the filled PI layer(s), and each additional layer may have any suitable thickness. Any suitable thickness ratios may be utilized with the filled PI layer(s) and the additional layer(s). An enamel system that combines filled PI layer(s) with one or more additional layers may provide a wide variety of benefits. For example, an overall cost of an enamel system may be reduced relative to a system that includes all filled PI. However, an overall performance of the enamel system (e.g., thermal endurance, corona resistance, etc.) may be comparable to that of insulation including all filled PI and/or suitable for a desired application (e.g., an electric vehicle application, etc.). As another example, an enamel system may provide enhanced flexibility that permits a magnet wire to be shaped or processed.

In certain example embodiments, magnet wire may be formed with a three-layer insulation system. A basecoat may be formed around a conductor from a first polymeric material, such as polyester, THEIC polyester, polyester imide, or PAI. In one example embodiment, the basecoat may be formed from THEIC polyester having a relatively high solids content and viscosity. A midcoat may be formed from filled PI over the basecoat. A topcoat, such as a topcoat formed from unfilled PAI, may then be formed over the filled PI midcoat. Each of the basecoat, midcoat, and topcoat may include any suitable number of sublayers that provide a desired layer thickness. Additionally, any suitable ratios of thicknesses between the basecoat, midcoat, and topcoat may be utilized. In certain embodiments, the basecoat may have a first thickness between approximately ten percent (10%) and seventy percent (70%) of a total insulation thickness; the midcoat may have a second thickness between approximately five percent (5%) and eighty percent (80%) of the total insulation thickness, and the topcoat may have a third thickness between approximately five percent (5%) and fifty percent (50%) of the total insulation thickness. In certain embodiments, the basecoat may occupy between approximately forty-five percent (45%) and sixty-five percent (65%) of a total thickness, the midcoat may occupy between approximately twenty-five percent (25%) and forty percent (40%) of the total thickness, and the topcoat may occupy between five percent (5%) and fifteen percent (15%) of the total thickness. In yet other embodiments, the basecoat may occupy between approximately forty-five percent (45%) and sixty-five percent (65%) of a total thickness, the midcoat may occupy between approximately five (5%) and forty percent (40%) of the total thickness, and the topcoat may occupy between five percent (5%) and thirty-five percent (35%) of the total thickness. It has been found in certain embodiments that a magnet wire may provide desired electrical performance if the midcoat occupies at least five percent (5%) of a total enamel insulation thickness. In other embodiments, desired electrical performance may be provided if the midcoat occupies at least fifteen, twenty, or twenty-five percent of a total enamel insulation thickness.

Other embodiments of the disclosure are directed to methods of making magnet wire that includes at least one layer of PI enamel insulation having improved corona resistance, thermal conductivity, and/or thermal life enhancement. For example, magnet wire may be formed that includes a three-layer insulation system. A conductor may be provided and a suitable enamel insulation system may be formed around the conductor. First, a basecoat of a first polymeric enamel insulation may be formed around the conductor. The basecoat may include any suitable materials, such as polyester, THEIC polyester, polyester imide, or PAI. In certain embodiments, forming the basecoat may include applying a varnish that includes a high viscosity and/or high solids content THEIC polyester material onto the conductor and curing the applied material. Following formation of the basecoat, a midcoat of a second polymeric enamel insulation may be formed around the conductor as a result of applying a varnish that includes filler material (e.g., a combination of silica dioxide and titanium dioxide) dispersed within a base polyimide material and curing the applied varnish. In certain embodiments, a high viscosity and/or high solids content polyimide material may be filled and applied. Following application of the midcoat, a topcoat of third polymeric enamel insulation may be formed around the midcoat. The topcoat may include any suitable materials, such as PAI. In certain embodiments, forming the topcoat may include applying a varnish that includes PAI onto the midcoat and curing the applied material. Additionally, the basecoat, midcoat, and topcoat may be formed with any suitable thickness and/or builds and a wide variety of ratios of thicknesses may be formed. When the formed magnet wire is subsequently bent 180 degrees around a 4 mm mandrel, a topcoat crack frequency is less than 1.25, where the topcoat crack frequency representing a number of cracks in the respective topcoats per twenty samples of the wire respectively bent around the mandrel.

Embodiments of the disclosure now will be described more fully hereinafter with reference to the accompanying drawings, in which certain embodiments of the disclosure are shown. This invention may, however, be embodied in many different forms and should not be construed as limited to the embodiments set forth herein; rather, these embodiments are provided so that this disclosure will be thorough and complete, and will fully convey the scope of the invention to those skilled in the art. Like numbers refer to like elements throughout.

Referring now to the drawings, FIG. 1A shows a cross-sectional end-view of an example round magnet wire 100, which includes a conductor 110 coated with enamel insulation. Any suitable number of enamel layers may be utilized as desired. As shown, a plurality of enamel layers, such as a basecoat 120 and a topcoat 130, may be formed around the conductor 110. In other embodiments, a single layer of enamel insulation may be utilized. In yet other embodiments, such as the embodiments described in greater detail below with reference to FIGS. 2A and 2B, more than two layers of enamel insulation may be utilized. For example, a magnet wire may include a basecoat enamel layer, a midcoat enamel layer, and a topcoat enamel layer. Further, one or more of the enamel layers may be a filled PI layer that includes a suitable inorganic filler, and the filler may include a combination of silica dioxide and titanium dioxide.

Figure 1B:
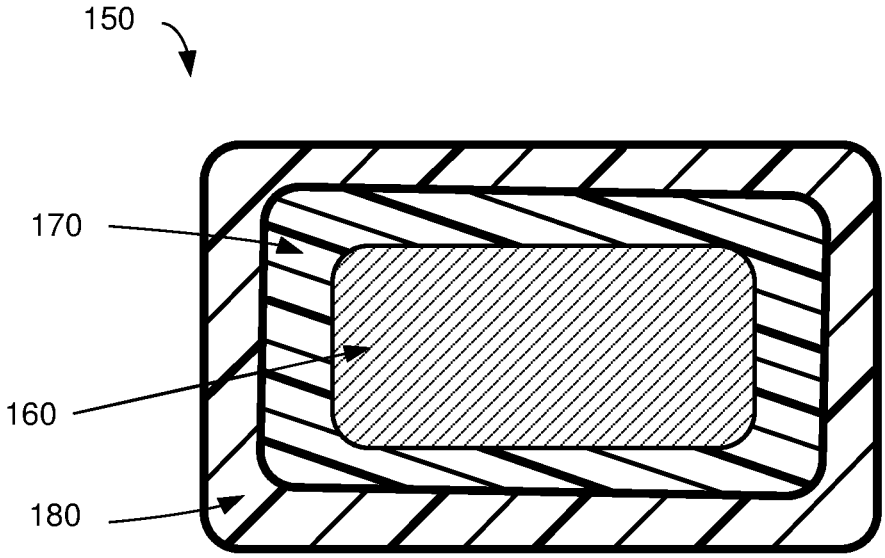

FIG. 1B shows a cross-sectional end-view of an example rectangular magnet wire 150, which includes a conductor 160 coated with enamel insulation. Any suitable number of enamel layers may be utilized as desired. As shown, a plurality of enamel layers, such as a basecoat 170 and a topcoat 180, may be formed around the conductor 160. In other embodiments, a single layer of enamel insulation may be utilized. In yet other embodiments, such as the embodiments described in greater detail below with reference to FIGS. 2A and 2B, more than two layers of enamel insulation may be utilized. For example, a magnet wire may include a basecoat enamel layer, a midcoat enamel layer, and a topcoat enamel layer. Further, one or more of the enamel layers may be a filled PI layer that includes a suitable inorganic filler, and the filler may include a combination of silica dioxide and titanium dioxide. The round wire 100 of FIG. 1A is described in greater detail below; however, it will be appreciated that various components of the rectangular wire 150 of FIG. 1B may be similar to those described for the round wire 100 of FIG. 1A.

The conductor 110 may be formed from a wide variety of suitable materials or combinations of materials. For example, the conductor 110 may be formed from copper, aluminum, annealed copper, oxygen-free copper, silver-plated copper, nickel plated copper, copper clad aluminum ("CCA"), silver, gold, a conductive alloy, a bimetal, carbon nanotubes, or any other suitable electrically conductive material. Additionally, the conductor 110 may be formed with any suitable cross-sectional shape, such as the illustrated circular or round cross-sectional shape. In other embodiments, a conductor 110 may have a rectangular (as shown in FIG. 1B), square, elliptical, oval, or any other suitable cross-sectional shape. As desired for certain cross-sectional shapes such as a rectangular shape, a conductor may have corners that are rounded, sharp, smoothed, curved, angled, truncated, or otherwise formed. The conductor 110 may also be formed with any suitable dimensions, such as any suitable gauge (e.g., 16 AWG, 18 AWG, etc.), diameter, height, width, cross-sectional area, etc. For example, a rectangular conductor may have short sides between approximately 1.0 mm and approximately 3.0 mm and long sides between approximately 2.0 mm and approximately 5.0 mm.

Any number of layers of enamel, such as the illustrated basecoat 120 and topcoat 130, may be formed around the conductor 110. An enamel layer is typically formed by applying a polymeric varnish to the conductor 110 and then baking the conductor 110 in a suitable enameling oven or furnace. The polymeric varnish typically includes thermosetting polymeric material or resin (i.e., solids) suspended in one or more solvents. A thermosetting or thermoset polymer is a material that may be irreversibly cured from a soft solid or viscous liquid (e.g., a powder, etc.) to an insoluble or cross-linked resin. Thermosetting polymers typically cannot be melted for application via extrusion as the melting process will break down or degrade the polymer. Thus, thermosetting polymers are suspended in solvents to form a varnish that can be applied and cured to form enamel film layers. Following application of a varnish, solvent is removed as a result of baking or other suitable curing, thereby leaving a solid polymeric enamel layer. As desired, a plurality of layers of enamel may be applied to the conductor 110 in order to achieve a desired enamel thickness or build (e.g., a thickness of the enamel obtained by subtracting the thickness of the conductor and any underlying layers). Each enamel layer may be formed utilizing a similar process. In other words, a first enamel layer may be formed, for example, by applying a suitable varnish and passing the conductor through an enameling oven. A second enamel layer may subsequently be formed by applying a suitable varnish and passing the conductor through either the same enameling oven or a different enameling oven. Additional layers are formed in a similar manner. An enameling oven may be configured to facilitate multiple passes of a wire through the oven. As desired, other curing devices may be utilized in addition to or as an alternative to one or more enameling ovens. For example, one or more suitable infrared light, ultraviolet light, electron beam, and/or other curing systems may be utilized.

Each layer of enamel, such as the basecoat 120 and the topcoat 130, may be formed with any suitable number of sublayers. For example, the basecoat 120 may include a single enamel layer or, alternatively, a plurality of enamel layers or sublayers that are formed until a desired build or thickness is achieved. Similarly, the topcoat 130 may include one or a plurality of sublayers. Each layer of enamel may have any desired thickness, such as a thickness of approximately 5, 10, 15, 20, 25, 30, 35, 40, 45, 50, 60, 70, 75, 80, 90, or 100 micrometers, a thickness included in a range between any two of the aforementioned values, and/or a thickness included in a range bounded on either a minimum or maximum end by one of the aforementioned values. A total insulation system (e.g., a combined thickness of the enamel layers) may also have any suitable thickness, such as a thickness of approximately, 30, 40, 50, 60, 70, 75, 80, 90, 100, 125, 150, 175, 200, 225, 250, 275, or 300 micrometers, a thickness included in a range between any two of the aforementioned values (e.g., a thickness between 60 and 100 microns, etc.), and/or a thickness included in a range bounded on either a minimum or maximum end by one of the aforementioned values. In certain embodiments, the example thickness values may apply to the thickness of an enamel layer or overall enamel system. In other embodiments, the example thickness values may apply to the build (e.g., a change in overall thickness of a wire resulting from addition of enamel, twice the thickness of an enamel layer or enamel system, the thickness on both sides of a wire resulting from the enamel layer or enamel system, etc.) of an enamel layer or overall enamel system. In yet other embodiments, the example thickness values provided above may be doubled in order to provide example build thickness values for an enamel layer or enamel system. Indeed, a wide variety of different wire constructions may be formed with enamel layers and/or insulation systems having any suitable thicknesses.

A wide variety of different types of polymeric materials may be utilized as desired to form an enamel layer. Examples of suitable thermosetting materials include, but are not limited to, polyimide ("PI"), polyamideimide ("PAI"), amideimide, polyester, tris(2-hydroxyethyl isocyanurate) or THEIC polyester, polyesterimide, polysulfone, polyphenylenesulfone, polysulfide, polyphenylenesulfide, polyetherimide, polyamide, polyketones, etc. According to an aspect of the disclosure, at least one enamel layer may include polyimide ("PI"). In certain embodiments, a plurality of polyimide layers may be formed. For example, both the basecoat 120 and the topcoat 130 may be formed as PI layers. In other embodiments, one or more PI layers may be combined with enamel layers formed from other types of material. For example, the basecoat 120 may be formed from PI while the topcoat 130 includes another polymeric material or blend of polymeric materials. Additionally, according to an aspect of the disclosure and as explained in greater detail below, one or more PI layers may be formed as filled PI layers.

In certain embodiments, the basecoat 120 may include one or more layers of filled PI, and an unfilled topcoat 130 (e.g., an unfilled PAI topcoat, etc.) may be formed over the basecoat 120. As desired, any suitable build or thickness ratio between the PI basecoat 120 and the topcoat 130 may be utilized. In certain embodiments, a thickness or build ratio between the PI basecoat 120 and the topcoat 130 may be between approximately 95/5 and approximately 85/15. In other words, the thickness or build of the topcoat 130 may constitute between approximately 5.0 percent and approximately 15.0 percent of the overall thickness or build of the combined enamel insulation. In other embodiments, the topcoat 130 may constitute approximately 2, 3, 5, 7, 10, 12, 15, 20, or 25 percent of the overall thickness or build of the combined enamel insulation.

Figure 2A:
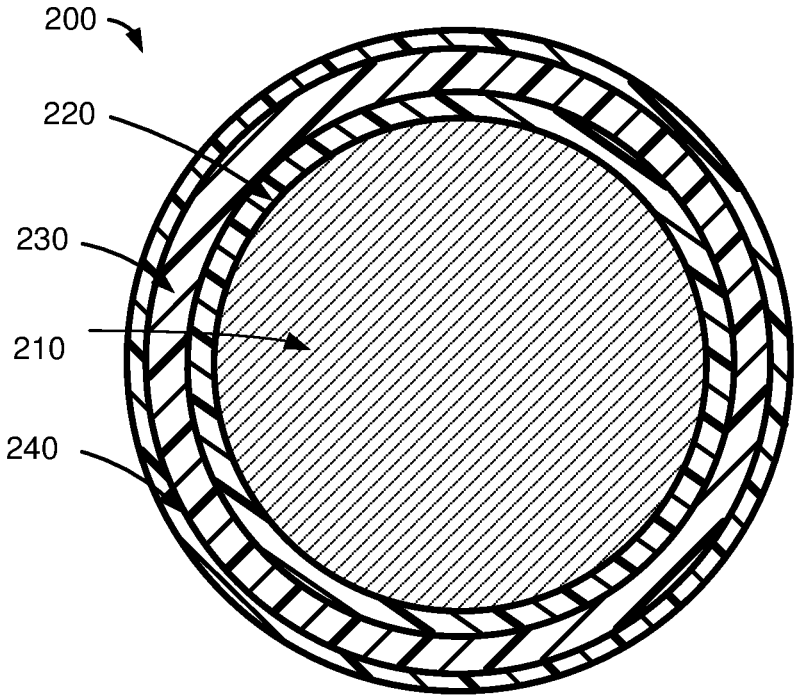
Figure 2B:
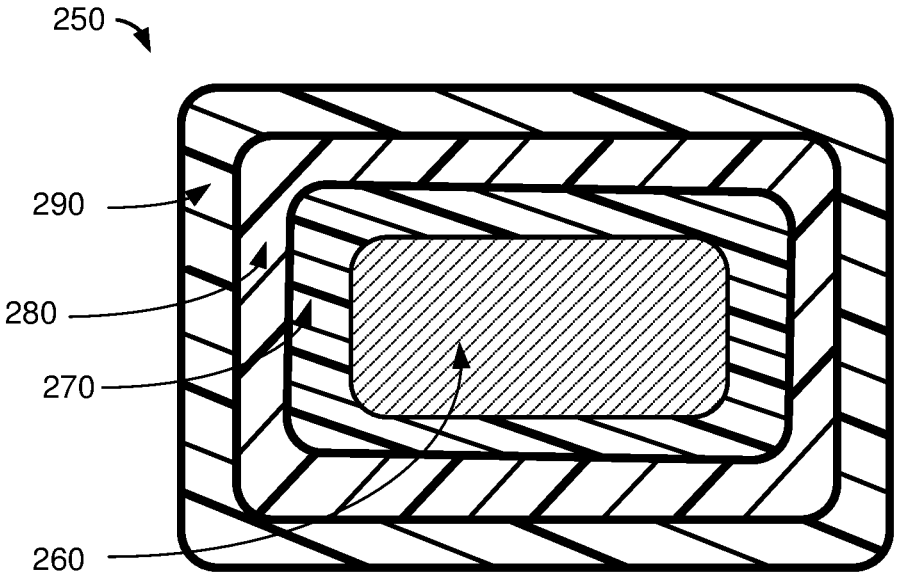

FIG. 2A shows a cross-sectional end-view of an example three-coat round magnet wire 200. The embodiment shown in FIG. 2A includes a conductor 210 surrounded by a polymeric basecoat 220, a first polymeric layer 230 disposed on the basecoat 220, and a second polymeric layer 240 disposed on the first polymeric layer 230. In certain embodiments, the first polymeric layer 230 may be referred to as a midcoat 230 and the second polymeric layer 240 may be referred to as a topcoat 240. Similarly, FIG. 2B shows a cross-sectional end-view of an example three-coat rectangular magnet wire 250. The wire 250 includes a conductor 260 surrounded by a polymeric basecoat 270, a first polymeric layer 280 (or midcoat 280) disposed on the basecoat 270, and a second polymeric layer 290 (or topcoat 290) disposed on the first polymeric layer 280. The round wire 200 of FIG. 2A is described in greater detail below; however, it will be appreciated that various components of the rectangular wire 250 of FIG. 2B may be similar to those described for the round wire 200 of FIG. 2A.

With respect to the wire 200 of FIG. 2A, the conductor 210 may be similar to the conductor 110 described above with reference to FIG. 1A. Additionally, a wide variety of suitable polymers may be utilized to form the various layers of enamel 220, 230, 240. Examples of suitable thermosetting materials include, but are not limited to, polyimide, polyamideimide, amideimide, polyester, THEIC polyester, polyesterimide, polysulfone, polyphenylenesulfone, polysulfide, polyphenylenesulfide, polyetherimide, polyamide, polyketones, etc. Similar to the wire 100 of FIG. 1A, the wire 200 of FIG. 2A may include at least one PI layer that includes a suitable filler. In certain embodiments, one or more filled PI layers may be formed around the conductor 210 (e.g., directly around the conductor 210, around a basecoat 220, etc.). As desired, one or more unfilled layers or self-lubricating layers, such as an unfilled topcoat 240, may then be formed around the one or more filled PI layers. For example, an unfilled layer of PI or an unfilled layer of PAI may be formed over the one or more filled PI layers. In certain embodiments, one or more unfilled layer(s) formed over filled PI may assist in decreasing tooling wear associated with the abrasive materials utilized as fillers in the filled PI layers. Additionally, each of the basecoat 220, first polymeric layer 230, and second polymeric layer 240 may include any desired number of sublayers.

As desired, the PI material utilized to form one or more PI layers incorporated into a magnet wire insulation system may be formed by reacting a dianhydride component (e.g., pyromellitic dianhydride or PMDA) with a diamine component (e.g., 4,4'-oxydianiline ("ODA"), 2,2-bis[4-(4-aminophenoxy)phenyl] propane ("BAPP"), etc.). PI formed by reacting PMDA and ODA has been found to have higher thermal performance than other types of PI, thereby enhancing the thermal index of a magnet wire. In certain embodiments, a plurality of PI layers may be formed. For example, two layers (e.g., a basecoat 220 and midcoat 230, a midcoat 230 and topcoat 240, etc.) or all three layers 220, 230, 240 may be formed from PI (e.g., an unfilled PI basecoat, a filled PI midcoat, an unfilled PI topcoat, etc.). In certain embodiments, multiple PI layers may include similar PI formulations (e.g., PI formed by reacting PMDA and ODA, etc.). In other embodiments, at least two PI layers may be formed from PI materials having different formulations. For example, a basecoat 220 (e.g., an unfilled basecoat 220) may be formed form PI that promotes enhanced adhesion to the conductor 210, such as PI formed by reacting PMDA with either BAPP or a blend of BAPP and ODA. A filled midcoat 230 may then include PI formed by reacting PMDA with ODA. As desired, a topcoat 230 may then be formed from unfilled PI or from another material, such as unfilled PAI.

In other embodiments, one or more PI layers may be combined with enamel layers formed from other types of thermoset material. In other words, one or more filled PI layers may be combined with additional layers in a multilayer enamel insulation system. In the event that one or more additional layers (e.g., layers other than filled PI) are incorporated into a magnet wire system, each additional layer may be formed with a wide variety of suitable constructions. For example, each additional layer of enamel may be formed as an unfilled layer or as a filled layer that includes any suitable filler materials. Further, any suitable number of additional layers may be combined with the filled PI layer(s), and each additional layer may have any desired number of sublayers and/or any suitable thickness. Any suitable thickness ratios may be utilized with the filled PI layer(s) and the additional layer(s). A wide variety of suitable combinations of enamel layers may be formed from any suitable materials and/or combinations of materials.

In certain embodiments, a magnet wire 200 may be formed with a three-layer insulation system. A basecoat 220 may be formed from a first polymeric material, such as polyester, THEIC polyester, polyester imide, or PAI. A midcoat 230 may be formed from filled PI. A topcoat 240, such as a topcoat formed from unfilled PAI, may then be formed over the filled PI midcoat 230. Each of the basecoat 220, midcoat 230, and topcoat 240 may include any suitable number of sublayers that provide a desired layer thickness.

As one example, a basecoat 220 may include THEIC polyester. As desired, a THEIC polyester or modified THEIC polyester enamel may be formed from a material having a relatively high solids content and/or a relatively high viscosity. For example, the solids content may be at least 40% and preferably at least 50%. In certain embodiments, the solids content may be between 50% and 55%. In certain embodiments, the THEIC polyester material may have a viscosity of at least 25,000 centipoise, such as a viscosity between 25,000 and 65,000 centipoise. As a result of including a relatively high solids content and high viscosity, a basecoat 220 may be formed with a relatively low concentricity, such as a concentricity below 1.2 or below 1.1. This remains true for rectangular wire (such as the wire 250 of FIG. 2B), in which a varnish will typically flow or move (e.g., flow to the corners) between application on the wire and curing into an enamel layer. By forming a basecoat 220 with a low concentricity, the concentricities of subsequent layers may be improved and the flexibility of the insulation system may be enhanced.

Any suitable ratios of thicknesses between the basecoat 220, midcoat 230, and topcoat 240 may be utilized in various embodiments. As desired, the thicknesses of different enamel layers may be based at least in part upon a desired application for the magnet wire 200 (e.g., hybrid and electric vehicle applications, etc.) and associated performance requirements, such as desired thermal performance, corona resistance, partial discharge performance, flexibility, etc. In certain embodiments, the basecoat 220 may have a first thickness that is between approximately ten percent (10%) and seventy percent (70%) of a total insulation thickness; the midcoat 230 may have a second thickness that is between approximately five percent (5%) and eighty percent (80%) of the total insulation thickness, and the topcoat 240 may have a third thickness that is between approximately five percent (5%) and fifty percent (50%) of the total insulation thickness. In certain embodiments, the basecoat 220 may occupy between approximately forty-five percent (45%) and sixty-five percent (65%) of a total thickness, the midcoat 230 may occupy between approximately twenty-five percent (25%) and forty percent (40%) of the total thickness, and the topcoat 240 may occupy between five percent (5%) and fifteen percent (15%) of the total thickness. In yet other embodiments, the basecoat may occupy between approximately forty-five percent (45%) and sixty-five percent (65%) of a total thickness, the midcoat may occupy between approximately five (5%) and forty percent (40%) of the total thickness, and the topcoat may occupy between five percent (5%) and thirty-five percent (35%) of the total thickness.

A wide variety of other suitable thickness ratios between a basecoat 220, midcoat 230, and topcoat 240 may be utilized as desired. In certain embodiments, the thickness of a filled PI layer (e.g., a filled PI midcoat 230, etc.) relative to the other enamel layers (e.g., a basecoat 220 and topcoat 240) may result in an insulation system having a desired overall performance that is improved relative to conventional enamel insulation systems. In other words, when the filled PI insulation occupies a sufficient level of the overall insulation thickness, a magnet wire 200 may exhibit one or more desired performance characteristics, such as a desired thermal index, a desired thermal life, a desired corona resistance, a desired partial discharge inception voltage, etc. In certain embodiments, a filled PI enamel layer (e.g., a filled PI midcoat 230, etc.) may occupy at least five percent (5%) of the overall insulation thickness. Indeed, the filled PI enamel layer may be sufficient for certain applications if it is thick enough to disperse a corona charge. In other embodiments, the filled PI enamel layer (e.g., a filled PI midcoat 230, etc.) may occupy at least twenty-five percent (25%) or at least thirty percent (30%) of the overall insulation thickness. In various other embodiments, the filled PI enamel may have a thickness that occupies at least 5, 10, 15, 20, 25, 30, 35, 40, 45, 50, 60, 70, 75, or 80% of the overall enamel thickness, or a thickness included in a range between any two of the above values.

A wide variety of benefits may be provided by incorporating a filled PI into a multi-layer enamel insulation system. In certain embodiments, incorporation of a filled PI enamel layer (e.g., a filled midcoat layer 230 in a three-layer insulation system, etc.) may improve the thermal performance, corona discharge performance, and/or the partial discharge performance of a magnet wire insulation system relative to conventional magnet wires. These performance characteristics may be similar or comparable to insulation that includes all filled PI enamel. However, the combination of additional layers (i.e., non-filled PI layer(s)) may lower or reduce an overall cost of the enamel insulation system relative to enamel that includes all filled PI or higher cost materials. In other words, a sufficient amount of filled PI enamel may be included to attain desired performance while lower cost enamel(s) may be utilized to achieve a desired overall insulation build or thickness and/or to promote other desired parameters, such as adhesion to the conductor 210 and/or lower abrasion. With continued reference to the wires 100, 150, 200, 250 of FIGS. 1A-2B, one or more suitable additives may optionally be incorporated into one or more enamel layers. An additive may serve a wide variety of purposes, such as promotion of adhesion between various components and/or layers of a wire, enhancing the flexibility of the insulation system, providing lubrication, enhancing viscosity, enhancing moisture resistance, and/or promoting higher temperature stability. For example, an additive may function as an adhesion promoter to assist or facilitate greater adhesion between an enamel layer and an underlying layer (e.g., a conductor, a basecoat, an underlying enamel layer, etc.), and/or between the filler material(s) and a base polymeric material. A wide variety of suitable additives may be utilized as desired in various embodiments. In certain embodiments, an additive may be formed from or may include a material formed by reacting an amine moiety with an aldehyde material (e.g., a glyoxal material, a formaldehyde material, etc.). For example, a Cymel™ material or resin, such as Cymel materials manufactured and marketed by Allnex, may be utilized as an additive in conjunction with PI or other thermoset materials. In other embodiments, a formaldehyde-free additive may be utilized. A suitable Cymel material or other additive may be utilized to facilitate greater adhesion between a PI enamel layer and an underlying layer (e.g., a basecoat, a conductor, etc.), to bind the base PI polymeric material to the filler material, and/or to enhance flexibility. Other types of Cymel materials and/or crosslinking materials may be utilized as desired.

In certain embodiments, one or more suitable surface modification treatments may be utilized on a conductor and/or any number of enamel layers to promote adhesion with a subsequently formed enamel layer. Examples of suitable surface modification treatments include, but are not limited to, a plasma treatment, an ultraviolet ("UV") treatment, a corona discharge treatment, and/or a gas flame treatment. A surface treatment may alter a topography of a conductor or enamel layer and/or form functional groups on the surface of the conductor or enamel layer that enhance or promote bonding of a subsequently formed layer. The altered topography may also enhance or improve the wettability of a varnish utilized to form a subsequent enamel layer by altering a surface tension of the treated layer. As a result, surface treatments may reduce interlayer delamination.

As desired in various embodiments, one or more other layers of insulation may be incorporated into a magnet wire 100, 150, 200, 250 in addition to a plurality of enamel layers. For example, one or more extruded thermoplastic layers (e.g., an extruded overcoat, etc.), semi-conductive layers, tape insulation layers (e.g., polymeric tapes, etc.), and/or conformal coatings (e.g., a parylene coating, etc.) may be incorporated into a magnet wire 100, 150, 200, 250. A wide variety of other insulation configurations and/or layer combinations may be utilized as desired. Additionally, an overall insulation system may include any number of suitable sublayers formed from any suitable materials and/or combinations of materials.

According to an aspect of the disclosure, one or more polyimide layers (and potentially other enamel layers) may include a suitable filler. For example, one or more PI enamel layers incorporated into a magnet wire, such as magnet wires 100, 150, 200, 250, may include a suitable filler. Additionally, the filler may include a blend of at least titanium dioxide ($TiO_2$) and silica dioxide ($SiO_2$). A blend of titanium dioxide and silica dioxide may additionally include other suitable materials as desired, such as chromium(III) oxide ($Cr_2O_3$). In other embodiments, the filler may include a blend of at least chromium oxide and silica dioxide. The addition of the filler may improve the corona resistance and/or thermal life of an enamel layer formed from filled PI on a magnet wire (e.g., the basecoat 120 in FIG. 1A, the midcoat 230 in FIG. 2A, etc.). As a result, the life of the magnet wire and/or an electrical device (e.g., motor, etc.) incorporating the magnet wire may be increased or extended under partial discharge and/or other adverse conditions.

The addition of the filler may also improve the thermal conductivity of a magnet wire 100, 150, 200, 250. One or more filled PI insulation layers may conduct or draw heat away from the conductor of a magnet wire. As a result, the magnet wire may operate at a relatively lower temperature than conventional magnet wires that do not include filled insulation layers. For example, when utilized in an electric machine, the magnet wire and/or the electric machine may operate at a temperature that is approximately 5, 6, 7, 8, 9, 10, 11, or 12 degrees Centigrade lower than conventional devices that do not utilize filled insulation layers. This improved thermal conductivity may facilitate operation of magnet wire and/or electric machines at higher voltages, thereby improving output. In various embodiments, a filled PI insulation layer may have a thermal conductivity that is at least 1.5, 2, 3, or 4 times that of an unfilled PI insulation layer having a similar thickness. In other words, a filled PI insulation layer may have a first thermal conductivity that is at least 1.5, 2, 3, or 4 times that of a second thermal conductivity for the base PI material into which filler is added.

Filler material may be added to PI at any suitable ratio. In certain embodiments, a total amount of filler in a filled PI enamel insulation layer may be between approximately ten percent (10%) and approximately twenty-five percent (25%) by weight. For example, a total amount of filler may be between approximately fifteen percent (15%) and approximately twenty percent (20%) by weight. In various other embodiments, a total amount of filler may be approximately 5, 7.5, 10, 12.5, 15, 17, 17.5, 20, 25, 30, 35, 40, 45, or 50 percent by weight, an amount included in a range between any two of the above values, or an amount included in a range bounded on either a minimum or maximum end by one of the above values. Substantial improvement in the life of windings was not observed at total filler levels much below about 5% by weight and, for certain magnet wire applications, insulation flexibility may be unacceptable as the filler percentage by weight is increased and exceeds a threshold value. For example, flexibility may be negatively impacted at total filler levels greater than about 50% based on weight.

A wide variety of blending or mixing ratios may be utilized for various components incorporated into a filler. For example, titanium dioxide and silica dioxide may be blended at a wide variety of suitable ratios by weight. In various embodiments, a filler may include between approximately twenty percent (20%) and approximately eighty percent (80%) by weight of silica dioxide and between approximately twenty percent (20%) and approximately eighty (80%) by weight of titanium dioxide. For example, a filler may include approximately 20, 25, 30, 33, 35, 40, 45, 50, 55, 60, 65, 67, 70, 75, or 80 percent by weight of silica dioxide, a weight percentage included in a range between any two of the above values (e.g., between 20% and 40%, etc.), or a weight percentage included in a range bounded on either a minimum or maximum end by one of the above values (e.g., at least 20%, etc.). Similarly, a filler may include approximately 20, 25, 30, 33, 35, 40, 45, 50, 55, 60, 65, 67, 70, 75, or 80 percent by weight of titanium dioxide, a weight percentage included in a range between any two of the above values (e.g., between 20% and 40%, etc.), or a weight percentage included in a range bounded on either a minimum or maximum end by one of the above values (e.g., at least 20%, etc.). As desired a ratio of a first component (e.g., titanium dioxide) to a second component (e.g., silica dioxide) may be approximately 80/20, 75/25, 70/30, 67/33, 65/35, 60/40, 55/45, 50/50, 45/55, 40/60, 35/65, 33/67, 30/70, 25/75, 20/80, or any other suitable ratio.

In certain embodiments, the components utilized in a filler may be selected based upon one or more desired properties. For example, a first filler component (e.g., titanium dioxide, etc.) may be selected as an inorganic oxide having a relatively low resistivity and a second filler component (e.g., silica dioxide, etc.) may be selected as an inorganic oxide having a relatively large surface area. The mixture may be added to PI prior to formation of an enamel layer, and the PI enamel layer may include a mixture of a large surface area inorganic oxide and a low resistivity inorganic oxide. A large surface area inorganic oxide is believed to permit more energy to penetrate through the insulation, thereby reducing the degradation of the insulation caused by high voltage and high frequency wave shapes in electrical devices. Silica dioxide or silica is commercially available in grades having a wide variety of specific surface areas, such as surface areas ranging from approximately 90 to approximately 550 $m^2/g$. For example, AEROSIL 90, available from Evonik Degussa Corporation, has a specific surface area of 90 $m^2/g$, and CAB-O-SIL EH-5, available from Cabot Corporation, has a specific surface area of 380 $m^2/g$. In certain embodiments, the resistance to the voltage wave shapes present in the windings of an electrical device may be improved with increasing silica surface area. Thus, silica grades having specific surface areas between approximately 380 $m^2/g$ and approximately 550 $m^2/g$ are preferred, or silica grades having specific surface areas greater than approximately 380 $m^2/g$, 550 $m^2/g$, or another threshold value may provide improved performance.

The components of a filler may include any suitable particle sizes, surface areas, and/or other dimensions. For example, a filler component may have a nominal particle size that is less than approximately one micron. In certain embodiments, a filler component may include nanoparticles. Additionally, a wide variety of suitable methods and/or techniques may be utilized to add a filler to a PI polymer. In certain embodiments, a filler may be media-milled, ball-milled, or otherwise ground or milled in order to reduce agglomerates to below a desired amount, such as a Hegman gauge or grind of "eight" or finer. These are generally made at a higher concentration and can be reduced in the final "letdown" of the end formulation. As desired, the filler may be milled or ground until that particle size is below approximately 1.0 microns. Other particle sizes may be attained as desired. In certain embodiments, the filler may be milled directly into the PI varnish in the presence of solvent. In other embodiments, the filler may be milled in another substance and then added to the PI varnish. For example, a PI, PAI, or other paste that includes the filler may be formed, and the polymeric paste may then be combined with PI prior to application of an enamel layer. It will be appreciated that the addition of solvent during milling may keep the filler particles from re-agglomerating or clumping.

Once a filler has been dispersed in a PI polymer, the PI polymer may be applied to a conductor in any suitable manner. For example, uncured PI insulation may be applied to magnet wire using multi-pass coating and floating or wiping dies followed by curing at an elevated temperature (e.g., curing in an enameling oven). Any desired number of PI polymer layers may be incorporated into or formed on a magnet wire. In various embodiments, these PI layers may be formed directly around a conductor or over one or more base layers. Other enamel layers (e.g., basecoat enamel layers, a polyamideimide topcoat, etc.) may be formed in a similar manner.

A magnet wire 100, 150, 200, 250 that includes one or more filled PI enamel layers may exhibit improved corona resistance, thermal conductivity, and/or thermal performance relative to conventional magnet wire enamels. For example, use of one or more filled PI enamel layers may provide a thermal class, a thermal index, or a thermal endurance 240° C. magnet wire or higher. In certain embodiments, a wire that includes filled PI insulation may have a thermal class, a thermal index, or a thermal endurance of 260° C. or greater. In certain embodiments, the addition of one or more PAI layers (e.g., a PAI topcoat) may provide additional toughness and abrasion resistance without materially reducing the thermal class of the magnet wire. The thermal index of a magnet wire or magnet wire insulation layer is generally defined as a number in degrees Celsius that compares the temperature vs. time characteristics of an electrical insulation material. It may be obtained by extrapolating the Arrhenius plot of life versus temperature to a specified time, usually 20,000 hours. One test for measuring or determining the thermal index or thermal endurance of magnet wire is the ASTM D2307 test set forth by ASTM International. A thermal class generally specifies a range of thermal indexes established by a standards body, such as the National Electrical Manufacturers Association ("NEMA") or UL. For example, a 220 class material may have a thermal index between 220° C. and 239° C. while a 240 class material has a thermal index between 240° C. and another threshold value. Magnet wire including the inventive PI enamel was found to have a thermal index above 260, and the applicants were required to obtain a new thermal classification listing from UL as the highest existing UL thermal class was 240. Further, the addition of one or more fillers to PI may improve inverter duty life and/or electrical machine life without negatively affecting or ruining the thermal aging of the insulation. In certain embodiments, the addition of one or more fillers may improve or raise the thermal life of magnet wire insulation at certain temperatures. For example, use of filled PI insulation may result in a thermal life of greater than approximately 1,000, 2,000, 3,000, or 4000 hours at approximately 300° C. By contrast, conventional unfilled PI may have a thermal life between approximately 400 and 500 hours at approximately 300° C. A few examples illustrating positive results for filled PI are set forth in greater detail below.

As mentioned above, incorporation of filled PI layers into a multi-layer enamel insulation system (e.g., a three-layer system as illustrated in FIGS. 2A and 2B) may provide enhanced performance while also controlling the cost of the wire. For example, the filled PI layers may provide an improved thermal index, thermal life, corona performance, PDIV performance, and/or other desired characteristics relative to conventional magnet wire insulation systems; however, the combination of filled PI layer(s) with one or more layers formed from less expensive materials (e.g., THEIC polyester, PAI, etc.) may assist in controlling overall cost. Indeed, the unique combination and amount of filler materials in filled PI insulation, as well as the thickness ratios between the layers in an insulation system, may result in a desired thermal index that is higher than that of similarly priced conventional wires.

In certain embodiments, a multi-layer enamel system that includes a combination of filled PI and additional layer(s), such as a system that includes a THEIC polyester basecoat 220, a filled PI midcoat 230, and an unfilled PAI topcoat 240, may have a thermal index that exceeds a desired threshold value for a given application (e.g., an inverter duty wire for an elective vehicle or a hybrid electric vehicle, etc.). For example, a multi-layer insulation system may have a thermal index of at least 240° C. or at least 260° C. In various embodiments, a multi-layer insulation system may have a thermal index of at least 230, 235, 240, 245, 250, 255, or 260° C., or a thermal index included in a range between any two of the above values. In certain embodiments, the overall thermal index for the insulation system may exceed that provided by certain polymeric materials utilized to form additional layers (e.g., THEIC polyester, PAI, etc.). In other words, inclusion of a filled PI layer may improve the thermal index of an insulation system while inclusion of other layers may provide additional benefits (e.g., cost benefits, etc.).

In certain embodiments, a multi-layer enamel system that includes a combination of filled PI and additional layer(s), such as a system that includes a THEIC polyester basecoat 220, a filled PI midcoat 230, and an unfilled PAI topcoat 240, may exhibit enhanced partial discharge inception voltage ("PDIV") and dielectric breakdown or dielectric strength performance suitable for desired applications (e.g., hybrid and electric vehicle applications, etc.). In certain embodiments, a round wire having a three-layer insulation system may have a PDIV of at least 500 volts root mean square (RMS). A rectangular wire having a three-layer insulation system may have an average PDIV of at least 1,100 volts. In other embodiments, a rectangular wire may have an average PDIV of at least 1,000, 1050, 1,100, 1,150, or 1,200 volts, or a PDIV included in a range between any two of the above values. Additionally, a magnet wire having a three-layer insulation system may have a dielectric breakdown at room temperature of at least 15,000 volts. In various embodiments, the dielectric breakdown may be at least 15,000, 16,000, 17,000, 18,000, 19,000, or 20,000 volts, or a dielectric breakdown included in a range between any two of the above values.

Additionally, in certain embodiments, a multi-layer insulation system that combines filled PI with one or more additional enamel layers (e.g., THEIC polyester, etc.) may provide enhanced flexibility relative to certain conventional magnet wire insulation systems. This enhanced flexibility may permit magnet wire 200 to be more easily shaped or bent for incorporation into a desired application (e.g., a motor application, etc.) without cracking or otherwise damaging the insulation. For example, a magnet wire 200 may be more easily shaped into hairpins (e.g., approximately U-shaped hairpins) or other predefined shapes without damaging or compromising the insulation. It has been found that certain other insulation systems, such as certain insulation systems that incorporate filled PAI or PI insulation over a polyester base, have lower flexibility that may result in cracked enamel when subjected to similar bending or shaping. In certain embodiments, a magnet wire 200 having an insulation system that incorporates filled PI may have a flexibility that permits the wire 200 to be bent 180° around a 4 mm mandrel with a topcoat 240 crack frequency of less than 1.25. In other embodiments, the topcoat 240 crack frequency may be less than 1.25, 1.2, 1.0, 0.8, 0.75, 0.65, 0.5, 0.4, 0.25, 0.1, or a frequency included in a range between any two of the aforementioned values. In yet other embodiments, the topcoat 240 crack frequency may be zero. The topcoat crack frequency is defined as a total number of cracks identified in the topcoat 240 insulation layer per twenty samples of bent wire (e.g., a total number of cracks counted for the 20 samples divided by 20). As shown in the examples below, magnet wire having other insulation systems exhibited much lower flexibility that resulted in both topcoat cracks and/or cracks completely through the insulation system.

The magnet wires 100, 150, 200, 250 described above with reference to FIGS. 1A-2B are provided by way of example only. A wide variety of alternatives could be made to the illustrated magnet wires 100, 150, 200, 250 as desired in various embodiments. For example, a wide variety of different types of insulation layers may be incorporated into a magnet wire 100, 150, 200, 250 in addition to one or more enamel layers. As another example, the cross-sectional shape of a magnet wire 100, 150, 200, 250 and/or one or more insulation layers may be altered. Indeed, the present disclosure envisions a wide variety of suitable magnet wire constructions. These constructions may include insulation systems with any number of layers and/or sublayers.

EXAMPLES

The following examples are intended as illustrative and non-limiting, and represent specific embodiments of the present invention. Unless otherwise stated, the wire samples discussed in the examples were prepared as 18 AWG wire with a "heavy" enamel build. In other words, the wire enamels were applied to an 18 AWG copper wire using multi-pass coating and wiping dies. The "heavy" enamel build has a nominal insulation build of approximately 3.0 mils (76 microns).

A first example illustrated in Table 1 compares the effects of adding one or more unfilled PAI topcoat layers over unfilled PI enamel. Comparative samples were tested for heat aging, repeated scrape, thermal index, and thermal life at temperature.

TABLE 1

Effect of PAI topcoat on PI enamel

| Base PI | PAI Topcoat | % of solvent ret. | Snap + Mandrel | X-Thru (° C.) | H. Shock @ 300° C. | Heat Aging - 48 hrs @ 240° C. | Rep. Scrape | Thermal Index ASTM 2307 | Thermal Life - Log hrs |
|---|---|---|---|---|---|---|---|---|---|
| 12 passes | None | 0.7 | Pass | >500 | 2x pass | 1x pass | 10 | 254° C. | 1368 hours @ 290° C. |
| 10 passes | 2 passes | 0.8 | Pass | >500 | 2x pass | 3x fail | 75 | 245° C. | 1368 hours @ 290° C. |
| 11 passes | 1 pass | 0.6 | Pass | >500 | 2x pass | 3x pass | 124 | | |

As shown in Table 1, the formation of a single or multi-layer PAI topcoat over PI enamel has very little effect on the thermal properties of the wire. There is a small reduction in 48-hour heat aging results; however, the thermal aging is similar between wires having only PI enamel and wires having PAI topcoats. These results were unexpected because PAI and PI are normally not used in combination with one another due to perceived differences in curing. As shown by the repeated scrape test, the addition of a PAI topcoat greatly enhances abrasion performance of the wire. In the repeated scrape test, a weighted needle is placed into contact with a straight piece of wire, and the needle is scraped back and forth on the wire. The results of the test illustrate a number of scrapes required before the insulation is penetrated. Further, the Techrand windability results for the wire samples were similar. Accordingly, the wire samples had similar mechanical performance.

A second example set forth in Table 2 compares various fillers that may be added to PI as either a concentrate in PI or in a PAI paste. First, Table 2 illustrates the effects of adding fillers containing titanium dioxide and silica dioxide in PI. For the first examples shown in Table 2, the filler materials were added directly to PI to form a PI paste, and the PI paste was then added to PI used to form enamel insulation. Table 2 then illustrates enamels in which fillers were added to PAI to form a PAI paste, and the PAI paste was then added to PI. PAI paste was prepared with both blends of titanium dioxide and silica dioxide and with blends of chromium oxide and silica dioxide. For each of the filled PI enamels, the filler materials were ball-milled and utilized to form a paste that was then added to PI. In the event that a PAI paste is utilized, the overall amount of PAI in the final insulation may be up to approximately 20% by weight of the insulating resin and did not appear to materially compromise the thermal properties of the insulation.

TABLE 2

Comparative Filled PI and PAI Samples

| Base Material | Filler | Topcoat | % of solvent ret. | Inverter Life @ 200° C. | Snap + Mandrel | H. Shock @ 280° C. | Rep. Scrape | Thermal Aging Log hrs. |
|---|---|---|---|---|---|---|---|---|
| PI (No paste) | None | 1 pass of PAI | 0.6 | 3.7 hrs | Pass | 1x pass | 40 | ~1800 hours @ 290° C. |
| PI + PI paste + Cymel | 7.5% $TiO_2$ 7.5% $SiO_2$ | 1 pass of PAI | 1.1 | 588 hrs | Pass | 1x pass | 184 | >5800 hours @ 290° C. |
| PI + PAI paste + Cymel | 7.5% $TiO_2$ 7.5% $SiO_2$ | 1 pass of PAI | 1.1 | 528 hrs | Pass | 2x pass | 203 | >4000 hours @ 290° C. |
| PI + PAI paste with no Cymel | 7.5% $Cr_2O_3$ 7.5% $SiO_2$ | 1 pass of PAI | 0.9 | 336.9 hrs | Fail | 2x pass | 274 | 3098 hours @ 290° C. |
| PI + PAI paste + Cymel | 7.5% $Cr_2O_3$ 7.5% $SiO_2$ | 1 pass of PAI | 1.1 | 692 hrs | Pass | 2x pass | 284 | >2500 hours @ 290° C. |

In order to measure the inverter duty life, the various magnet wires were tested using an inverter drive and a three-phase motor. Typical dielectric twisted pairs were made from the wire and placed in an oven at 200° C. High voltage, high frequency wave forms from a 575-volt (1750 volt peak to peak) ac inverter drive were sent through each of the twisted pairs. The twisted pairs, which each had about the same length, were monitored until a short circuit occurred and the time to short circuit was recorded. The longer the time to short circuit (failure), the better the resistance to insulation degradation. The time to failure for the various magnet wire enamel formulations may be referred to as the measured or determined inverter life.

As shown in Table 2, filled PI, even filled PI containing a PAI "paste" of filler concentrate, may provide excellent inverter duty life relative to unfilled enamel materials. Additionally, filled PI may exhibit enhanced thermal aging as compared to unfilled PI materials. The addition of an adhesion promoter may improve flexibility, reduce delamination, and improve heat shock and repeated scrape in the wire samples.

A few samples that showed excellent results include PI enamel that is filled with a combination of titanium dioxide and silica dioxide. This filler combination provided the best survivability results during thermal aging test. As shown, one sample wire provided over 5000 hours at 290° C. during thermal aging test, which indicate higher thermal class or thermal index material. Indeed, magnet wire that includes filled PI enamel insulation in accordance with embodiments of this disclosure was later determined to have a thermal index above 260° C.

Samples of wire prepared with filled PI enamel that includes a combination of titanium dioxide and silica dioxide were also compared to several conventional magnet wires. The wires with filled PI enamel included both 18 AWG heavy build copper wires and larger 12 AWG copper wires. The 18 AWG wire samples were prepared with an enamel build of 0.0032 inches, and the 12 AWG wire samples were prepared with an enamel build of 0.0043 inches. These wires were compared to both conventional enameled wires (e.g., conventional unfilled PI wire) and to conventional wires insulated with corona resistant tapes wrapped around the conductors. The corona resistant tapes included both Kapton CR tapes manufactured by DuPont and Apical tapes manufactured by the Kaneka Corporation. Table 3 illustrates the results of the comparisons.

A wide variety of comparative tests were performed on the various wires, including thermal endurance, pulse endurance, dielectric breakdown, and repeated scrape testing. The thermal endurance testing was performed in accordance with an ASTM D2307 standard, as set forth by ASTM International. The pulse endurance testing was performed using a Chinese GB/T 21707-2008 test method with a 100 ns rise time. The dielectric breakdown testing was performed on twisted pairs formed from the magnet wire samples in accordance with standard NEMA test procedures set forth by the National Electrical Manufacturers Association.

The repeated scrape testing was performed using a similar procedure as that discussed above with reference to Table 1.

TABLE 3

Comparison of Filled PI Samples to Conventional Wires

| | 18 AWG Filled PI | 18 AWG PI | 12 AWG Filled PI | 12 AWG with Kapton Tape | 12 AWG with Apical Tape |
|---|---|---|---|---|---|
| Build (inches) | 0.0032 | 0.0032 | 0.0043 | 0.0070 | 0.0070 |
| Thermal Endurance (° C.) | 266 | 247 | >260 | 280 | |
| Pulse Endurance (hours) | >19.7 | 0.1 | >72 | 7.3 | 42.4 |
| Inverter Life @ 200° C. | 294 hrs | 3.9 hrs | | | |
| Heat Shock Resistance | Pass @ 300° C. | Pass @ 300° C. | Pass @ 300° C. | 4/5 inches @ 300° C. | 1 inch @ 300° C. |
| Dielectric Breakdown Voltage (volts) | 11,702 | 14,600 | 14,444 | 17,202 | 19,840 |
| Dielectric Breakdown Voltage at Rated Temperature | 7,146 V @ 240° C. | 10,400 V @ 240° C. | | 10,536 V @ 280° C. | 8,930 V @ 280° C. |
| Abrasion Resistance - Repeated Scrape | 115 | 30 | 192 | N/A | N/A |

As shown in Table 3, the 18 AWG wire with filled PI has much higher pulse endurance and inverter life as compared to conventional 18 AWG wire with unfilled PI. Thus, the filled PI wire will have improved corona resistance performance relative to the unfilled PI wire.

Additionally, the 12 AWG wire with filled PI has improved pulse endurance performance as compared to 12 AWG wires insulated with wrapped corona resistant polyimide tapes. The filled PI wire also has a thinner insulation build, thereby permitting the wire to have a smaller diameter than the wires insulated with tapes. Accordingly, it may be possible to incorporate the 12 AWG filled PI wire into applications that conventionally utilize wires with corona resistant tape insulation while simultaneously providing certain improved performance characteristics. The enamel insulated wires may also be easier to process and handle than conventional wires with tape insulation. Enameled wires are capable of being taken up and spooled by automated winding machines; however, these machines can damage tape insulation.

A fourth example illustrated in Table 4 compares the effects of adding fillers to PI in which titanium dioxide and silica dioxide have different blend ratios. The filled PI layers included approximately 15% of filler by weight, and the wire samples were formed at a line speed of approximately 20 feet per minute.

TABLE 4

Effects of Silica Dioxide/Titanium Dioxide Filler in PI

| Filler added to PI | Blend Ratio | % of solvent ret. | Voltage Endur. (mins) | Rep. Scrape | Dr @RT | Tan Delta - ° C. | Snap + Mandrel |
|---|---|---|---|---|---|---|---|
| None | N/A | 0.6 | 168 | 34 | 0.00181 | 285 | 1x |
| $TiO_2/SiO_2$ | 100/0 | 0.4 | 430 | 41 | 0.00525 | 176 | 2x |
| $TiO_2/SiO_2$ | 75/25 | 0.6 | 329 | 66 | 0.00369 | 226 | 2x |
| $TiO_2/SiO_2$ | 67/33 | 0.7 | 208 | 67 | 0.00318 | 229 | 2x tcc |
| $TiO_2/SiO_2$ | 50/50 | 0.6 | 223 | 58 | 0.00322 | 244 | 2x tcc |
| $TiO_2/SiO_2$ | 33/67 | 0.6 | 208 | 54 | 0.0032 | 250 | 2x tcc |
| $TiO_2/SiO_2$ | 25/75 | 0.6 | 238 | 52 | 0.00306 | 248 | 1x |
| $TiO_2/SiO_2$ | 0/100 | 0.9 | 213 | 43 | 0.00269 | 263 | 2x |

As shown in Table 4, the addition of filler containing titanium dioxide and silicon dioxide improves the inverter life of magnet wire having PI enamel. The addition of a PAI topcoat over filled PI enamel may also provide improved repeated scrape results.

For voltage endurance testing, a 3500 volt signal was communicated onto the wire samples at approximately 155° C. at approximately 10% elongation, where the elongation imparts additional stresses onto the wire. A time to failure was then measured for each of the wire samples. The $D_f$ and Tan Delta testing measures losses in the electrical insulation of the wire samples.

As shown in Table 4, higher amounts of titanium dioxide provide improved voltage endurance; however, the higher amounts of titanium dioxide also contribute to increased electrical losses in the insulation as exhibited by the $D_f$ and tan delta values. Similarly, higher amounts of silicon dioxide provide for less electrical losses in the insulation while having lower voltage endurance performance. Insulation performance can be optimized with blends of titanium dioxide and silicon dioxide as a filler. For example, insulation performance can be optimized with a filler including between approximately 20% and approximately 80% by weight of titanium dioxide and between approximately 20% and approximately 80% by weight of silicon dioxide. In one example embodiment, improved performance can be achieved with a filler than includes between approximately 60% and approximately 80% by weight of titanium dioxide and between approximately 20% and 40% by weight of silicon dioxide.

A fifth example illustrated in Table 5 evaluates the effects of adding fillers to PI on the thermal conductivity of the insulation. The thermal conductivity of filled PI insulation is compared to conventional unfilled PI insulation. The filled PI wire sample referenced in Table 5 included approximately 15% of filler by weight with approximately equal amounts by weight of titanium dioxide and silicon dioxide. The thicknesses of the filled PI and unfilled PI were approximately equal. Additionally, the thermal conductivities were measured using the ASTM D5470-17 test at approximately 150° C., as established by ASTM International.

TABLE 5

Effects of Filler on Thermal Conductivity of PI

| Insulation Layer | Thermal Conductivity (W/(mK)) |
|---|---|
| Polyimide | 0.1 |
| Filled Polyimide | 0.4 |

As shown in Table 5, the filled polyimide insulation may have a thermal conductivity that is much higher than unfilled polyimide. In other words, incorporation of filler material into a base polyimide material will enhance the thermal conductivity of the material, and the increased thermal conductivity may be at least twice that of the base polyimide material. As shown in Table 5, the increased thermal conductivity may be approximately four times that of the base polyimide material. When utilized as magnet wire insulation, the enhanced thermal conductivity of the filled insulation may draw heat away from the magnet wire conductor, thereby allowing the magnet wire to be utilized at higher voltages and enhancing the output of the magnet wire and/or an electric machine into which the magnet wire is incorporated.

While the examples set forth with reference to Tables 1-5 relate to magnet wire that includes one enamel layer (e.g., filled PI) or two enamel layers (e.g., filled PI with a PAI topcoat), the following examples primarily relate to three-layer enamel insulation systems. First, Table 6 provides thermal performance data for several example magnet wire constructions that include filled enamel layers in combination with other enamel layers. The first wire is an 18 AWG wire having a THEIC polyester basecoat with a build of approximately 38 microns, a filled PI midcoat (15% filler by weight with equal parts $TiO_2$ and $SiO_2$) with a build of approximately 25 microns, and an unfilled PAI topcoat with a build of approximately 10 microns. The second wire is an 18 AWG wire having a polyester basecoat with a build of approximately 38 microns, a filled PAI midcoat (15% filler by weight with equal parts $Cr_2O_3$ and $SiO_2$) with a build of approximately 25 microns, and an unfilled PAI topcoat with a build of approximately 8 microns. The third wire is a 16 AWG wire having a polyester basecoat with a build of approximately 40 microns, a filled PAI midcoat (25% filler by weight with a 3:1 $TiO_2$ and $SiO_2$ ratio) with a build of approximately 46 microns, and an unfilled PAI topcoat with a build of approximately 6 microns. For thermal testing, 10 samples of each type of wire were electrified and tested at different temperatures and the time to insulation failure was determined. At the time of this application's filing, full testing was not yet complete.

TABLE 6

Thermal Aging for Wires with Different Multi-layer Insulation Systems

| | First Wire | Second Wire | Third Wire |
|---|---|---|---|
| Failures out of 10 at 240° C. | 0 | 8 | |
| Hours to Date | 4704 | 5376 | |
| Failures out of 10 at 260° C. | 0 | 10 | 10 |
| Hours to Date | 4032 | 1479 | 3064 |
| Failures out of 10 at 280° C. | 10 | 10 | 10 |
| Hours to Date | 1312 | 120 | 377 |

As shown in Table 6, the first wire had the best thermal performance of the three tested wires. Although full testing was not completed, the first wire has a thermal index exceeding 240° C. and will likely have a thermal index exceeding 260° C. Accordingly, a multi-layer construction that combines a THEIC polyester basecoat, a filled PI midcoat, and a PAI topcoat may have a similar thermal performance to a magnet wire that includes primarily filled PI insulation.

Table 7 provides partial discharge inception voltage ("PDIV") and dielectric breakdown values for the three wire types described above with reference to Table 6. PDIV and dielectric breakdown values are provided for both round wire samples and rectangular wire samples having similar constructions for each wire type. The round wire constructions are the same as those described above with reference to Table 6. For the rectangular samples, the first wire has a THEIC polyester basecoat with a build of approximately 50 microns, a filled PI midcoat (15% filler by weight with equal parts $TiO_2$ and $SiO_2$) with a build of approximately 26 microns, and an unfilled PAI topcoat with a build of approximately 9 microns. The second wire has a polyester basecoat with a build of approximately 51 microns, a filled PAI midcoat (15% filler by weight with equal parts $Cr_2O_3$ and $SiO_2$) with a build of approximately 25 microns, and an unfilled PAI topcoat with a build of approximately 9 microns. The third wire has a polyester basecoat with a build of approximately 50 microns, a filled PAI midcoat (25% filler by weight with a 3:1 $TiO_2$ and $SiO_2$ ratio) with a build of approximately 30 microns, and an unfilled PAI topcoat with a build of approximately 8 microns.

Industry standard PDIV tests were performed using a commercially available PDIV testing machine in which a specific ramp of voltages is applied to wire samples at a constant current and an appropriate PDIV value is determined. A root mean square ("RMS") PDIV is reported for round wire samples, and a peak PDIV is calculated for rectangular wire samples. To determine the dielectric breakdown of the round wire samples, a ramped voltage up to 20,000 volts is applied at different temperatures to twisted pairs formed from the wire, and a point of insulation failure or breakdown is identified. For rectangular wire, first testing was performed on lashed pairs of wire samples. Wire pairs were slightly bent, lashed together, and then subjected to a ramped voltage up to 20,000 volts at different temperatures. Additionally, a shotbox test was performed in which samples are placed in a box surrounded by ball bearings. A ramped voltage is then applied up to 20,000 volts, and a point of insulation failure is determined.

TABLE 7

PDIV and Dielectric Breakdown of Different Multi-layer Insulation Systems

| | First Wire | Second Wire | Third Wire |
|---|---|---|---|
| Round Wire Samples | | | |
| PDIV (RMS at 23° C.) | 572 V | 586 | |
| PDIV (RMS at 150° C.) | 534 V | 512 | |
| Dielectric Breakdown (23° C.) | 11,072 V | 10,710 V | |
| Dielectric Breakdown (220° C.) | 8,636 V | 7,368 V | |
| Dielectric Breakdown (240° C.) | 6,962 V | 6,160 V | |
| Rectangular Wire Samples | | | |
| PDIV, Vpk (Room T) | 1203 V | 1186 V | 1165 V |
| Dielectric Breakdown (Room T) | 16,387 V | 14,745 V | 17,367 V |
| Dielectric Breakdown (240° C.) | 8,489 V | 10,178 V | 8,391 V |
| Dielectric Breakdown (Shotbox at 240° C.) | 6,371 V | 6,060 V | 6,777 V |

As shown in Table 7, all of the tested wires exhibit PDIV and dielectric breakdown performance that is acceptable for a wide variety of applications, such as hybrid and electric vehicle applications. The first wire exhibited the best PDIV performance.

Table 8 provides flexibility data for the three wire types described above with reference to Table 6. Both round samples (having the construction described above for Table 6) and rectangular samples (having the construction described above for Table 7) were tested. For round wire, samples were elongated and wrapped in a coil around mandrels having different sizes. Heat shock resistance tests were also performed in which samples were elongated twenty percent, wrapped around different mandrels, and then heated for half an hour at different temperatures (e.g., 240° C. and 260° C.). The mandrel sizes are approximately equal to the diameters of the tested samples. Determinations were then made as to whether any cracks are formed in the topcoat insulation (i.e., a PAI topcoat) and, in some cases, whether the insulation cracked to the bare conductor. For rectangular wire, samples were bent 180° around 4 mm, 6 mm, 8 mm, and 10 mm mandrels, and determinations were made as to whether any cracks are formed in the topcoat insulation or to the bare conductor. Based upon the tests, a topcoat crack frequency was calculated for the different types of wire. The topcoat crack frequency represents a number of cracks in the respective topcoats per 20 tested samples of wire (i.e., 20 samples of a given wire type).

TABLE 8

Flexibility Comparison of Various Multi-layer Insulation Systems

| | First Wire | Second Wire | Third Wire |
|---|---|---|---|
| Round Wire Samples | | | |
| 1xD Mandrel Wrap | 0 | Cracked to bare | Cracked to bare |
| Heat Shock 240° C. | 0 | Cracked to bare | Cracked to bare |
| Heat Shock 260° C. | 0 | Cracked to bare | |

TABLE 8-continued

| Flexibility Comparison of Various Multi-layer Insulation Systems | | | |
|---|---|---|---|
| | First Wire | Second Wire | Third Wire |
| 2xD Mandrel Wrap | 0 | 0 | Cracked to bare |
| Heat Shock 240° C. | 0 | 0 | Topcoat cracks |
| Heat Shock 260° C. | 0 | | |
| 3xD Mandrel Wrap | 0 | 0 | Topcoat cracks |
| Heat Shock 240° C. | 0 | 0 | Topcoat cracks |
| Heat Shock 260° C. | 0 | 0 | |
| Rectangular Wire Samples | | | |
| 4 mm Mandrel Bend | 0.65 | 2.15 | 3.22 |
| 6 mm Mandrel Bend | 0.09 | 0.75 | 1.00 |
| 8 mm Mandrel Bend | 0 | | 0.40 |
| 10 mm Mandrel Bend | 0 | | 0.20 |

As shown in Table 8, the first wire has much greater flexibility than the second and third wire types, both for round and rectangular samples. Indeed, the respective round and rectangular samples for the second and third wires often cracked through all of the insulation layers to expose a bare copper conductor. By contrast, topcoat cracks were identified in the first wire under 30× magnification. For certain sample runs of the first wire, the topcoat crack frequency was zero. Thus, it can be concluded that the unique enamel layer constructions of the first wire provides much greater flexibility than the other tested wires. This is especially true for rectangular wire, which is required for many hybrid and electric vehicle automotive applications.

Although the samples included in Tables 2-8 provide for specific blend ratios of filler materials, overall fill rates (e.g., approximately 15% by weight of the insulation, etc.), layer constructions and layer thicknesses in multi-layer systems, and ratios of layer thicknesses, a wide variety of other suitable blend ratios, fill rates, layer constructions, and layer thickness ratios may be utilized in other embodiments.

Conditional language, such as, among others, "can," "could," "might," or "may," unless specifically stated otherwise, or otherwise understood within the context as used, is generally intended to convey that certain embodiments could include, while other embodiments do not include, certain features, elements, and/or operations. Thus, such conditional language is not generally intended to imply that features, elements, and/or operations are in any way required for one or more embodiments or that one or more embodiments necessarily include logic for deciding, with or without user input or prompting, whether these features, elements, and/or operations are included or are to be performed in any particular embodiment.

Many modifications and other embodiments of the disclosure set forth herein will be apparent having the benefit of the teachings presented in the foregoing descriptions and the associated drawings. Therefore, it is to be understood that the disclosure is not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. A magnet wire comprising:

a conductor; and an insulation system formed around the conductor, the insulation system comprising:

a basecoat of first polymeric enamel insulation having a first thickness that is between forty-five percent and sixty-five percent of a total thickness of the insulation system;

a midcoat of second polymeric enamel insulation formed around the basecoat and having a second thickness that is between twenty-five percent and forty percent of the total thickness, the second polymeric enamel insulation comprising a filler dispersed in a base polyimide material, wherein the filler comprises between 20 percent and 80 percent by weight of silica dioxide and between 20 and 80 percent by weight of titanium dioxide; and a topcoat of third polymeric enamel insulation formed around the midcoat and having a third thickness that is between five percent and fifteen percent of the total thickness.

2. The magnet wire of claim 1, wherein a topcoat crack frequency is less than 1.25 when the wire is bent 180 degrees around a 4 mm mandrel, the topcoat crack frequency representing a number of cracks in the respective topcoats per twenty samples of the wire respectively bent around the mandrel.

3. The magnet wire of claim 1, wherein the basecoat comprises one of (i) polyester, (ii) THEIC polyester, (iii) polyester imide, or (iv) polyamideimide.

4. The magnet wire of claim 1, wherein the topcoat comprises unfilled polyamideimide.

5. The magnet wire of claim 1, wherein the filler comprises between 10 percent and 25 percent by weight of the second polymeric enamel insulation.

6. The magnet wire of claim 1, wherein the insulation system has a thermal index of at least 240° C.

7. The magnet wire of claim 1, wherein the insulation system has a thermal index of at least 260° C.

8. The magnet wire of claim 1, wherein the total thickness is at least 50 micrometers.

9. A magnet wire comprising:

a conductor; and an insulation system formed around the conductor, the insulation system comprising:

a basecoat of first polymeric enamel insulation having a first thickness that is between forty-five percent and sixty-five percent of a total thickness of the insulation system;

a midcoat of second polymeric enamel insulation formed around the basecoat and having a second thickness that is between twenty-five percent and forty percent of the total thickness, the second polymeric enamel insulation comprising a filler dispersed in a base polyimide material, wherein the filler comprises between 20 percent and 80 percent by weight of silica dioxide and between 20 and 80 percent by weight of titanium dioxide; and a topcoat of third polymeric enamel insulation formed around the midcoat and having a third thickness that is between five percent and fifteen percent of the total thickness, wherein a topcoat crack frequency is less than 1.25 when the wire is bent 180 degrees around a 4 mm mandrel, the topcoat crack frequency representing a number of cracks in the respective topcoats per twenty samples of the wire respectively bent around the mandrel.

10. The magnet wire of claim 9, wherein the basecoat comprises one of (i) polyester, (ii) THEIC polyester, (iii) polyester imide, or (iv) polyamideimide.

11. The magnet wire of claim 9, wherein the topcoat comprises unfilled polyamideimide.

12. The magnet wire of claim 9, wherein the filler comprises between 10 percent and 25 percent by weight of the second polymeric enamel insulation.

13. The magnet wire of claim 9, wherein the insulation system has a thermal index of at least 240° C.

14. The magnet wire of claim 9, wherein the total thickness is at least 50 micrometers.

15. The magnet wire of claim 9, wherein the insulation system has a thermal index of at least 260° C.

16. A magnet wire comprising:

a conductor; and an insulation system with a total thickness formed around the conductor, the insulation system comprising:

a basecoat of first polymeric enamel insulation comprising THEIC polyester, the basecoat formed with a first thickness that is between forty-five percent and sixty-five percent of the total thickness;

a midcoat of second polymeric enamel insulation formed around the basecoat with a second thickness that is between twenty-five percent and forty percent of the total thickness, the second polymeric enamel insulation comprising a filler dispersed in a base polyimide material, wherein the filler comprises between 20 percent and 80 percent by weight of silica dioxide and between 20 and 80 percent by weight of titanium dioxide; and a topcoat of third polymeric enamel insulation comprising polyamideimide, the topcoat formed around the midcoat with a third thickness that is between five percent and fifteen percent of the total thickness.

17. The magnet wire of claim 16, wherein a topcoat crack frequency is less than 1.25 when the wire is bent 180 degrees around a 4 mm mandrel, the topcoat crack frequency representing a number of cracks in the respective topcoats per twenty samples of the wire respectively bent around the mandrel.

18. The magnet wire of claim 16, wherein the filler comprises between 10 percent and 25 percent by weight of the second polymeric enamel insulation.

19. The magnet wire of claim 16, wherein the insulation system has a thermal index of at least 240° C.

20. The magnet wire of claim 16, wherein the total thickness is at least 50 micrometers.

21. The magnet wire of claim 16, wherein the insulation system has a thermal index of at least 260° C.

* * * * *